US007677056B2

(12) United States Patent
Panganiban

(10) Patent No.: US 7,677,056 B2
(45) Date of Patent: Mar. 16, 2010

(54) PORTABLE COOLING SYSTEM FOR A BEVERAGE CONTAINER

(76) Inventor: Frank Panganiban, 302 Broadmoor La., Bartlett, IL (US) 60103

( * ) Notice: Subject to any disclaimer, the term of this patent is extended or adjusted under 35 U.S.C. 154(b) by 774 days.

(21) Appl. No.: 11/251,234

(22) Filed: Oct. 15, 2005

(65) Prior Publication Data

US 2007/0084236 A1 Apr. 19, 2007

(51) Int. Cl.
*F25D 3/08* (2006.01)

(52) U.S. Cl. ..... 62/457.4; 62/371

(58) Field of Classification Search ..... 62/371, 62/457.1, 457.2, 457.3, 457.4, 457.8, 475.3
See application file for complete search history.

(56) References Cited

U.S. PATENT DOCUMENTS 4,463,664 A * 8/1984 Peace ..... 99/323.3
4,830,190 A * 5/1989 Inagaki ..... 206/550
5,042,258 A * 8/1991 Sundhar ..... 62/3.2
5,283,420 A * 2/1994 Montalto ..... 219/432
5,345,784 A * 9/1994 Bazemore et al. ..... 62/371
5,842,353 A * 12/1998 Kuo-Liang ..... 62/190
6,330,808 B1 * 12/2001 Kouwenberg et al. ..... 62/372
6,378,325 B1 * 4/2002 Yang ..... 62/457.6
6,513,661 B1 * 2/2003 Mogil ..... 206/579
6,789,693 B2 * 9/2004 Lassiter ..... 220/592.18

* cited by examiner

*Primary Examiner*—Melvin Jones
(74) *Attorney, Agent, or Firm*—Raymond M. Galasso; Galasso & Associates, L.P.

(57) ABSTRACT

A portable cooling system for maintaining a beverage container at an internal temperature dissimilar to that of the temperature of its external surroundings comprising of a substantially circular shaped storage compartments with a hingly attached lid. The portable cooling system further includes a flexible temperature sleeve positioned in the interior volume of the storage compartment during use. The temperature sleeve contains a plurality of ribs being configure to have an internal chamber filled with temperature controlling substance.

15 Claims, 1 Drawing Sheet

PORTABLE COOLING SYSTEM FOR A BEVERAGE CONTAINER

FIELD OF THE INVENTION

The present invention relates a portable cooling system, more specifically but not by way of limitation, a portable cooling system designed to reduce and then maintain a temperature differential of a beverage can that has been inserted into the system and its external surroundings.

BACKGROUND

Individuals engage in numerous activities where transportation of beverages is desired. During transportation and upon arrival, maintaining a desired temperature for the beverage is normally accomplished by utilizing a conventional cooler.

Transporting conventional coolers when only a single beverage is desired to be transported is not practical as conventional coolers can be large and difficult to transport. For example, many workers transport a meal to be consumed while at work. A typical way of transporting a meal and drink is a plastic or paper bag. Many facilities do not offer refrigerators to store the drinks or access to such devices is inconvenient. As it is usually several hours before the meal and drink are consumed, many consider it desirable to maintain a cool temperature for the beverage. Utilizing a conventional cooler for such an activity is not practical as only one beverage is desired to be transported.

Another problem exists is that conventional coolers require ice to be deposited therein to make and keep the contents cold. As the ice melts, it requires that it be removed from the cooler.

Another example of current devices that are used to transport beverages in small quantities is a conventional thermos. Typically, a desired beverage is poured into the thermos along with ice and the device is then closed for transportation. A problem with this method is that after a period of time the ice melts and dilutes the beverage contained in the conventional thermos. Additionally, the thermos must be cleaned between uses.

Accordingly, there is a need for a portable cooling system that is designed to cool and maintain the lowered temperature of beverages in the original containers, such as but not limited to an aluminum can, that is compact and easily transported, prevents the dilution of the beverage by utilizing an external temperature control sleeve that surrounds the beverage container, and does not need to be cleaned after every use.

SUMMARY OF THE INVENTION

It is an object of the present invention to provide a portable cooling system for a single beverage container that can isolate and maintain the temperature of the single beverage container from the external ambient temperature and be easily transported by an individual. The portable cooling system has a cooling and insulating device capable of cooling and maintaining a temperature of a single beverage container and the contents therein and thermally isolate the container and contents from its external surroundings. The system includes a removable temperature control sleeve that is positioned interposed an insulation layer and the beverage container.

It is a further object of the present invention to provide a portable cooling system for a single beverage container that is compact and lightweight for easy transportation.

Yet another object of the present invention is to provide a portable cooling system for a single beverage container that has a lid releasably secured thereto in order to completely encase the beverage container thereby maintaining a sanitary environment for the beverage container and providing further internal climate control.

Another object of the present invention is to provide a portable cooling system for a single beverage container that has a device that allows the system to be releasably secured to a belt worn by an individual for ease of transportation.

To the accomplishment of the above and related objects the present invention may be embodied in the form illustrated in the accompanying drawings. Attention is called to the fact that the drawings are illustrative only. Variations are contemplated as being part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
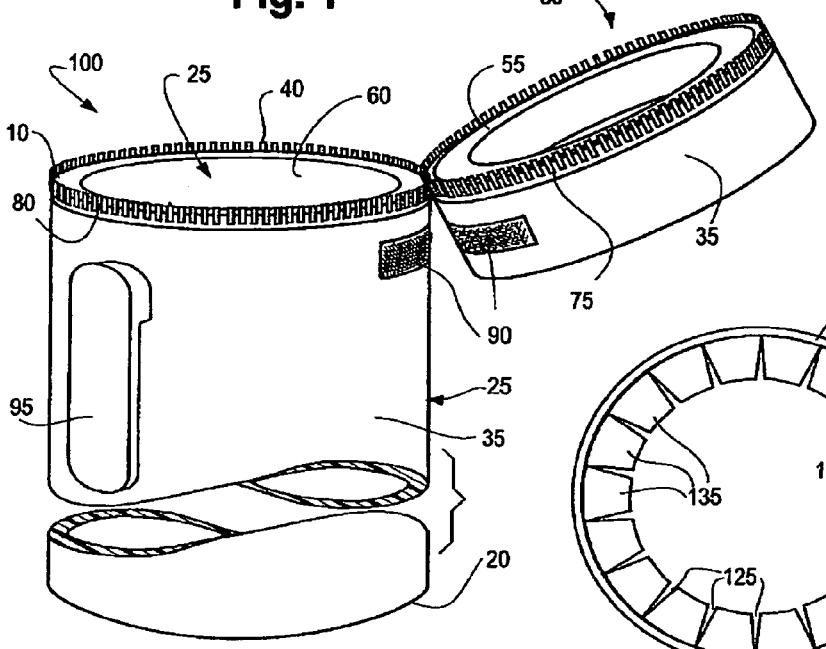
FIG. 1 illustrates a perspective view of a preferred embodiment of the present invention.
Figure 2:
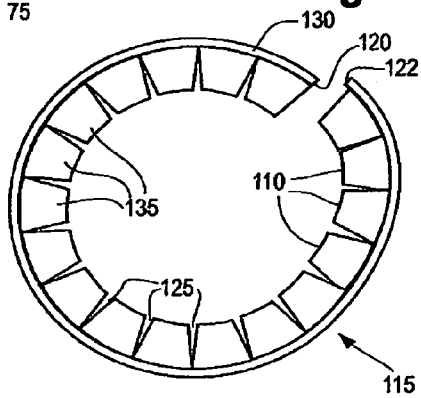
FIG. 2 illustrates a perspective view of the temperature control sleeve.
Figure 3:
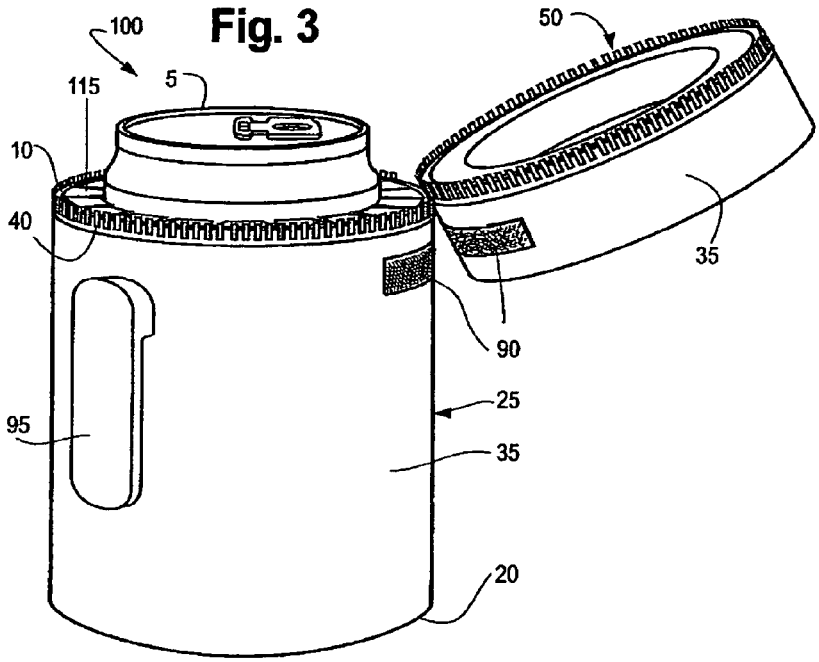
FIG. 3 illustrates a perspective view of a preferred embodiment of the present invention with a beverage container inserted therein.

Referring now to the drawings, wherein various elements depicted are not necessarily drawn to scale, and in particular FIG. 1 through 3, there is illustrated the components of a preferred embodiment of a portable cooling system constructed according to the principles of the present invention.

The first component of the system is the storage compartment 100. The storage compartment 100 is generally annular in shape and hollow to allow receipt therein of a beverage container 5. The storage compartment 100 has a wall 10 and a bottom 20 configured to define an interior volume of the storage compartment 100 and an opening 25 at the top of the storage compartment. Proximate to the opening 25 is the upper peripheral edge 40. For storage compartment 100, good results have been achieved with measurements designed to accommodate a conventional beverage containers, such as but not limited to twelve ounce aluminum beverage container, or plastic, disposable beverage bottles.

The wall 10 and the bottom 20 are constructed of an insulating material such as but not limited to foam. Although good results have been achieved with a wall 10 that is one-quarter of an inch in thickness, it is understood that the thickness of wall 10 will depend on the type of insulating material used and the desired performance of such.

Although it is illustrated in the preferred embodiment that one wall 10 and a bottom 20 are used to construct the main body 25 of the storage compartment 100, it is contemplated within the scope of the present invention that a plurality of walls configured with a bottom could be used to construct a storage compartment 100 in order to achieve the function suggested herein.

The wall 10 has an exterior surface 35 that is substantially disposed thereon. The exterior surface 35 is constructed of nylon. The exterior surface 35 of nylon prevents. degradation of the foam wall 10 and provides a suitable surface for an individual to grip the storage compartment 100. The exterior surface 35 is mounted to the wall by conventional chemical methods. Those skilled in the art will recognize that numerous materials could be used in place of and/or in conjunction with nylon to construct the exterior surface 35 to achieve the desired function suggested herein.

The wall 10 has an interior liner 60 that is substantially disposed about the interior volume of the storage compartment 100. The interior liner 60 serves to provide additional insulation for a beverage container to be disposed therein. The interior liner 60 is constructed of a liquid impermeable material to prevent any condensation from propagating into the foam wall 10. Good results have been achieved in the construct of the interior liner 60 with conventional materials such as the reflective waterproof materials used in standard soft-sided ice chest.

Proximate to the opening 25 and hingly connected to the exterior surface 35 of the wall 10 is the lid 50. The lid 50 is designed to be releasably secured to the main body 25 of the storage compartment 100. The lid 50 is generally annular in shape and integrally formed with a top 65 and an upper wall 55 to form an interior volume and is of a particular diameter to allow the lid 50 to mate securely with the main body 25 of the storage compartment 100. The top 65 and upper wall 55 are constructed of an insulating material such as but not limited to foam. Good results have been achieved with an upper wall 55 that is three-quarters of an inch in thickness, however it is contemplated that the thickness will depend on the type of insulation and desired performance.

Substantially disposed about the exterior of the lid is the exterior surface 35. The lid 50 has a lower peripheral edge 75 that has circumferentially disposed thereon a zipper 80. The zipper 80 is a conventional zipper that consists of two interlocking halves with the opposing half of the zipper 80 mounted along the upper peripheral edge 40. The zipper 80 functions to releasably secure the lid 50 in its first position to the main body 25 thereby encapsulating the beverage container 5 in the storage compartment 100. Once releasably secured with the zipper 80, the beverage container 5 is protected from any debris and is completely surround by insulating material allowing the storage compartment 100 to maintain and isolate the temperature of beverage container 5 and its contents to that the external surroundings.

Those skilled in the art will recognize that numerous different types of attachment mechanisms could be used in place of and/or in conjunction with the zipper 80 to achieve the desired functionality as suggested herein.

One half of an attachment mechanism 90 is positioned opposite the zipper 80 and secured to the exterior surface 35 of the lid 50. The opposing half of the attachment mechanism 90 is secured to the exterior surface 35 of the main body 25 of the storage compartment 100 proximate to and beneath the upper peripheral edge 40. The opposing halves of the attachment mechanism 90 function to releasably secure the lid 50 into its second position, which allows access to the beverage container 5 contained within the storage compartment 100.

The attachment mechanism 90 is constructed of conventional hook/loop fasteners and is secured by suitable chemical or mechanical methods such as but not limited to stitching or chemical adhesion. Those skilled in the art will recognize that numerous different materials or devices could be used in place of and/or in conjunction with the hook/loop fasteners to achieve the functionality suggested herein of the attachment mechanism 90. More specifically but not by way of limitation conventional snaps could be used to secure the lid 50 in the lid's 50 second position to the main body 25.

A belt clip 95 is mounted contiguous to the exterior surface 35 of the main body 25 and configured in a generally perpendicular manner. The belt clip 95 functions to allow an individual using the portable cooling system to temporarily fasten the storage compartment 100 to their belt or other location for ease of transportation. The belt clip 95 is made of conventional material such as but not limited to a resilient metal. The belt clip 95 is mounted to the exterior surface 35 of the main body 25 by known chemical or mechanical methods such as but not limited to chemical adhesion or mechanical rivets. Those skilled in the art will recognize that numerous different types of materials could be used in place of and/or in conjunction with metal to achieve the functionality as suggested herein of the belt clip 95.

Now referring specifically to FIG. 2, there is illustrated the second component of the portable cooling system, the temperature sleeve 115. The temperature sleeve 115 is comprised of a membrane 130 having a first end 120 and a second end 122. The membrane 130 is configured in a substantially planar manner and is constructed of a flexible liquid impermeable material such as but not limited to plastic. The length of temperature sleeve 115 can be varied depending upon the desired container to be cooled. Good results have been achieved in making the length of temperature sleeve 115 such that the opening of the container of to be cooled can be readily accessible by the consumer. For example, if a soda in a typical can is to be cooled, the desired length of temperature sleeve 115 would be such that a user could easily consume the soda in the container from its opening and not have the temperature sleeve 115 interfere with the consumption of the soda.

Superposed on one side of the membrane 130 is a plurality of temperature ribs 110. The temperature ribs 110 are comprised of three walls 130 that are integrally formed with the membrane 130 to form an internal chamber 135. The internal chamber 135 has substantially disposed therein a suitable liquid or gel that has general properties of slow temperature dissipation and absorption.

Upon changing the temperature of the temperature sleeve 115 by introduction for a sustained period of time into a freezer or other device, the material within the internal chamber 135 will reach or approach the operating temperature of the freezer or device and be able to maintain that temperature for an extended period of time once removed from the freezer or other device and placed into the storage compartment 100. The material disposed within the internal chamber 135 of the temperature ribs 110 not only helps to maintain a temperature the interior volume of the storage compartment 100 but will also cool the temperature of the interior volume and contents there if, when inserted, the contents are at a temperature different than that of the temperature sleeve 115. If for example, a can of soda at room temperature is inserted into the portable cooling system and the temperature sleeve 115 has been substantially chilled in a freezer, temperature sleeve 115 will cool off the contents of the can of soda, and once cooled help maintain the cooled temperature.

The temperature ribs 110 are integrally formed with the membrane 130 and are formed with the membrane 130 to create a plurality of notches 125. The notches 125 allow the temperature sleeve 115 to be configured in circular manner whereby the first end 120 and the second end 122 are adjacent to one another and then placed inside the storage compartment 100 interposed to the beverage container and wall 10. The beverage container 5 biases the temperature sleeve 115 against the interior lining 60. The temperature ribs 110 are adjacent to the beverage container 5 upon placement into the storage compartment 100 as the temperature sleeve 115 encircles the beverage container 5.

Those skilled in the art will recognize that the temperature sleeve 115 could be utilized to maintain a temperature in the storage compartment 100 that is either cooler or warmer than that of its external surroundings. It is contemplated to be within the scope of the present invention that the size of the storage compartment 100 could be manufactured to accommodate numerous different sizes and types of beverage containers. More specifically but not by way of limitation, the storage compartment 100 could be configured to accept therein bottles or larger cans. It is further contemplated within the scope of the invention that the storage compartment 100 could be manufactured in a plurality of colors and patterns.

Referring in particular to the drawings submitted herewith, in particular FIGS. 1 and 2; a description of the operation of the portable cooling system is as follows. In use, a user would place the temperature sleeve 115 in a device such as a freezer for a sufficient time to allow the material in the internal chamber 135 to reach a temperature similar to its environment. Once the temperature has been reached, the temperature sleeve 115 is removed from the device and is configured by the user to a generally circular shape by placing the first end 120 and the second end 122 of the membrane 130 adjacent to each other.

The lid 50 is placed in its second position and secured with the attachment mechanism 90 to allow access to the internal volume of the storage compartment 100. The temperature sleeve 115 is then placed into the storage compartment 100 adjacent to the interior lining 60 with the temperature ribs 110 facing inward. The user then places the desired beverage container 5 in the storage compartment 100 adjacent to the temperature sleeve 115. The user then secures the lid 50 in its first position with the zipper 80. This closes the portable cooling system and increases the efficiency of the system in maintaining a temperature of the internal volume of the storage compartment 100 dissimilar to that of the external environment.

The user may then use the belt clip 95 to aid in transportation of the portable cooling system to the desired location. Once ready to use, the user will release the lid 50 from the storage compartment 100 by releasing the zipper 80 and securing the lid 50 into its second position. The user then consumes the desired amount of beverage contained in the beverage container 5 and returns the lid 50 to its first position. This process is repeated as desired until the beverage is consumed.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable cooling system comprising:

a storage compartment having at least one wall and a bottom, said wall and said bottom configured to define an interior volume with an opening for receipt of objects therein;

a lid configured to fit over the opening of said storage compartment, said lid for closing the opening of said storage compartment, wherein said lid has a first position in which said lid is mated over said opening of said storage compartment and a second position wherein said lid is removed from said opening of said storage compartment, wherein said lid is secured into said second position with a hook/loop fastener;

a temperature controller removably disposed within at least a portion of said storage compartment;

an attachment device for releasably securing said lid into said first position, wherein said attachment device is a zipper; and a belt clip mounted to the external surface of said storage compartment, said belt clip for releasably securing said portable cooling system to a belt.

2. The portable cooling system as recited in claim 1, wherein said controller further includes a membrane integrally formed with at least one chamber having an internal volume, said chamber containing material for freezing therein.

3. A portable cooling system for maintaining the temperature of a single beverage container dissimilar to that of its external surroundings comprising:

a storage compartment having one insulated wall and an insulated bottom, said wall and said bottom configure to define an interior volume for receipt of a beverage container therein, said all and said bottom further being configured to have an open end;

an insulated lid, said lid hingly mounted to said storage compartment proximate to said open end, said lid for closing said open end of said storage compartment; and a removable temperature sleeve for controlling the interior volume of said storage compartment, said sleeve removably interposed between said wall of said storage compartment and said beverage container.

4. The portable cooling system as recited in claim 3, and further including a zipper, said zipper located proximate to said open end of said storage compartment, said zipper for releasably securing said lid to said storage compartment in a first position, wherein said lid closes said open end.

5. The portable cooling system as recited in claim 4, and further comprising an attachment mechanism, said attachment mechanism for securing said lid into a second position, wherein said lid is removed from said open end allowing access to said interior volume of said storage compartment.

6. The portable cooling system as recited in claim 5, wherein said attachment mechanism is a hook/loop fastener.

7. The portable cooling system as recited in claim 6, and further comprising a belt clip centrally mounted to the exterior surface of the storage compartment, said belt clip for allowing said portable cooling system to be releasably secured to a belt.

8. The portable cooling system as recited in claim 7, wherein said temperature sleeve further includes a flexible membrane having a first end and a second end and a plurality of temperature ribs integrally formed therewith, said ribs further being configured with three walls to define an internal chamber, said internal chamber containing a temperature controlling compound therein.

9. The portable cooling system as recited in claim 8, wherein said temperature sleeve further includes a plurality of notches, said notches interposed to said temperature ribs, said notches for allowing said sleeve to be formed into a generally cicular shape by placing said first end and said second end adjacent to each other.

10. the portable cooling system as recited in claim 9, wherein said walls and said lid are constructed to form foam.

11. A portable cooling system for cooling a beverage container and the contents therein, comprising:

a storage compartment having one insulated wall and an insulated bottom, said wall and said bottom configured to define an interior volume for receipt of a beverage container thereing, said interior volume substantially lines with a waterproof material, said wal and said bottom further being configured to have an open end, said storage compartment being generally circular in shape; and an insulated lid, said lid having a first position and a second position, said lid hingly mounted to said storage compartment proximate to said open end, said lid for closing said open end of said storage compartment;

a removable temperature sleeve for controlling the interior volume of said storage compartment, said sleeve surroundably mounted adjacent said beverage container, said sleeve further being configured with a flexible membrane having a first end and a second end, said sleeve having a plurality of temperature ribs being configured with three walls defining an internal chamber, said internal chamber containing a temperature controlling substance therein; and a belt clip, said belt clip for releasably securing said portable cooling system to a belt, said belt clip mounted to the exterior of said storage compartment.

12. The portable cooling system as recited in claim 11, wherein said temperature sleeve further includes a plurality of notches, said notches interposed to said temperature ribs, said notches for allowing said sleeve to be shaped into a generally circular shape whereby said first end and said second end are adjacently located.

13. The portable cooling system as recited in claim 12, wherein said sleeve is biased against the interior lining by said beverage container.

14. The portable cooling system as recited in claim 13, wherein said wall in one-quarter of an inch in thickness.

15. The portable cooling system as recited in claim 14, and further including an exterior surface substantially disposed on said lid and said storage compartment, and said exterior surface is nylon wherein said exterior surface prevents degradation of the foam wall and further provides a gripping surface for use.

* * * * *